US005467497A

United States Patent [19]

Greene et al.

[11] Patent Number: 5,467,497

[45] Date of Patent: Nov. 21, 1995

[54] ADJUSTABLE DRYWALL CORNER TOOL

[76] Inventors: Gary L. Greene, 5126 Snover Rd., Carsonville, Mich. 48419; George Spector, 233 Broadway Rm. 702, New York, N.Y. 10279

[21] Appl. No.: 303,729

[22] Filed: Sep. 9, 1994

[51] Int. Cl.[6] ..... B05C 17/10

[52] U.S. Cl. ..... 15/235.8; 425/458

[58] Field of Search ..... 15/235.3, 235.4, 15/235.7, 235.8; 425/458

[56] References Cited

U.S. PATENT DOCUMENTS

| | | | |
|---|---|---|---|
| 109,073 | 11/1870 | Streeter | 15/235.8 |
| 398,781 | 2/1889 | Hovey | 15/235.7 |
| 1,370,060 | 3/1921 | Smith | 15/235.7 |
| 1,383,688 | 7/1921 | Word | 15/235.7 |
| 2,178,899 | 11/1939 | Shaffer | 15/235.7 |
| 4,757,572 | 7/1988 | Yon | 15/235.8 |

*Primary Examiner*—Edward L. Roberts, Jr.

[57] ABSTRACT

An adjustable drywall corner tool comprising a pair of work engaging blades normally disposed substantially at a ninety degree angle to one another. A hinge extends between mating edges of the blades. A structure is for changing the angle between the two blades, so that the blades will fit in an inside corner of more and less than the ninety degree angle. A handle extends from the angle changing structure, so that a person can grip the handle to apply taping to the corner.

2 Claims, 1 Drawing Sheet

ADJUSTABLE DRYWALL CORNER TOOL

BACKGROUND OF THE INVENTION

The instant invention relates generally to corner trowels and more specifically it relates to an adjustable drywall corner tool, which provides a mechanism for changing the angle between the two blades.

There are available various conventional corner trowels which do not provide the novel improvements of the invention herein disclosed.

SUMMARY OF THE INVENTION

A primary object of the present invention is to provide an adjustable drywall corner tool that will overcome the shortcomings of the prior art devices.

Another object is to provide an adjustable drywall corner tool that contains a mechanism for changing the angle between two blades, so that the blades can properly fit in corners of more or less than ninety degrees.

An additional object is to provide an adjustable drywall corner tool in which the hinge between the adjustable blades can be locked in any angle, so that the tool can be used for taping both inside corners and outside corners.

A further object is to provide an adjustable drywall corner tool that is simple and easy to use.

A still further object is to provide an adjustable drywall corner tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
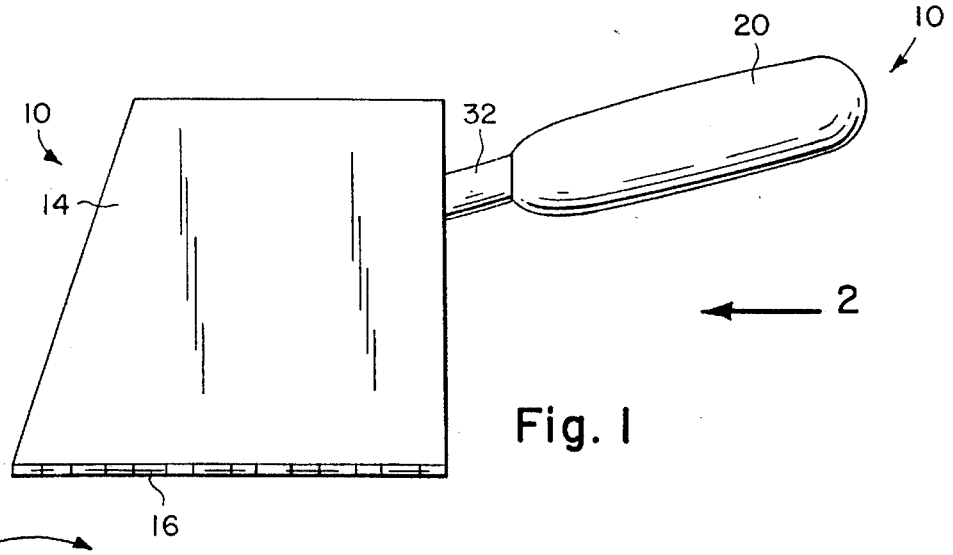
FIG. 1 is a side view of the instant invention.

Turning now descriptively to the drawings, in which similar reference characters denote similar elements throughout the several views, FIGS. 1 through 4 illustrate an adjustable drywall corner tool 10 comprising a pair of work engaging blades 12 and 14 normally disposed substantially at a ninety degree angle to one another. A hinge 16 extends between mating edges of the blades 12 and 14. A structure 18 is for changing the angle between the two blades 12 and 14, so that the blades will fit in an inside corner of more or less than the ninety degree angle. A handle 20 extends from the angle changing structure 18, so that a person can grip the handle 20 to apply taping to the corner.

Figure 2:
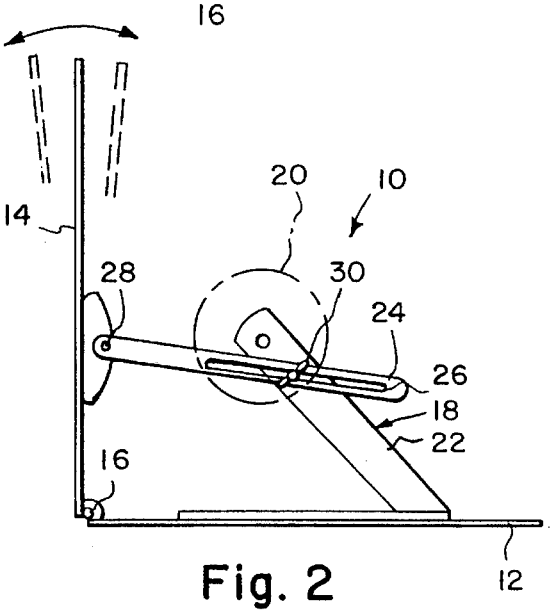
FIG. 2 is a rear view taken in the direction of arrow 2 in FIG. 1, with the handle in phantom showing the adjustment mechanism therein.

The angle changing structure 18, as best seen in FIG. 2, includes a stationary arm 22 affixed at one end to an inner surface of the first blade 12. An adjustable arm 24 has a longitudinal slot 26 and is pivotally mounted at one end 28 to an inner surface of the second blade 14. A wing headed setscrew 30 fits through the slot 26 in the adjustable arm 24 and threads into the stationary arm 22. The second blade 14 can be put at a different angle to the first blade 12 and is retained in that position by the tightening of the setscrew 30. The handle 20 contains a ferrule 32, which is attached perpendicular to a free end of the stationary arm 12.

Figure 3:
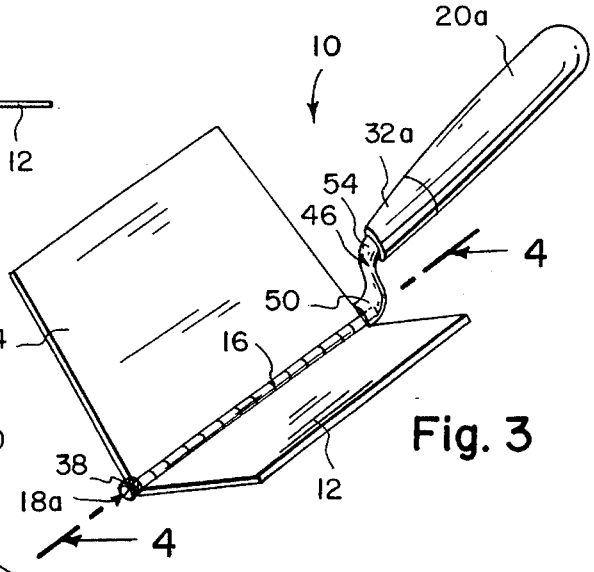
FIG. 3 is a perspective view of a modification showing a locking pin in the hinge between the adjustable blades.
Figure 4:
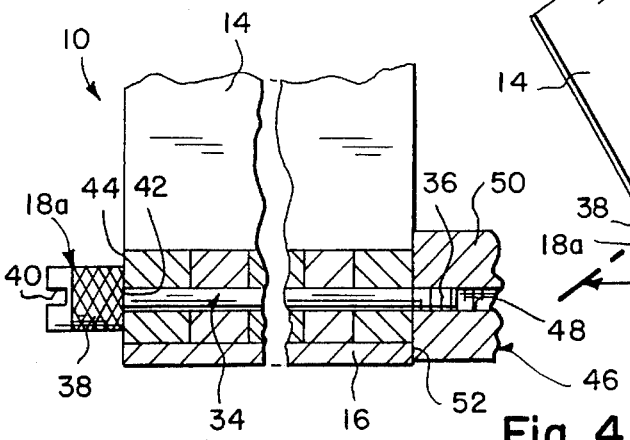
FIG. 4 is a cross sectional view with parts broken away taken along line 4—4 in FIG. 3 in the hinge, showing the locking pin bolt in greater detail.

Another angle changing structure 18*a*, best seen in FIGS. 3 and 4, consists of a locking pin bolt 34 having an externally threaded first end 36 that extends through the hinge 16 and an enlarged knurled head 38 with a slot 40 on a second end 42 of the locking pin bolt 34, to make contact with a first side 44 of the hinge 16. An enlarged S-shaped shaft 46 has an internally threaded aperture 48 in a first end 50, for engagement with the externally threaded first end 36 of the locking pin bolt 34, to make contact with a second side 52 of the hinge 16. The blades 12 and 14 can be put at a different angle and retained in that position by the tightening of the knurled head 38 of the locking pin bolt 34. The handle 20*a* includes a ferrule 32*a*, which is attached to a second end 54 of the S-shaped shaft 46.

OPERATION OF THE INVENTION

To use the adjustable drywall corner tool 10, as shown in FIGS. 1 and 2, a person simply loosens the setscrew 30 and moves the second blade 14 to any angle position desired. The setscrew 30 is then tightened to retain the second blade 14 in that position.

To use the adjustable drywall corner tool 10, as shown in FIGS. 3 and 4, a person simply loosens the knurled head 38 of the locking pin bolt 34 and moves the second blade 14 to any angle position desired. The knurled head 38 is then tightened to retain the second blade 14 in that position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adjustable drywall corner tool comprising:

a) a pair of work engaging blades normally disposed substantially at a ninety degree angle to one another;

b) a hinge extending between mating edges of said blades;

c) means for changing the angle between said two blades, so that said blades will fit in an inside corner of more and less than the ninety degree angle;

d) a handle extending from said angle changing means, so that a person can grip said handle to apply taping to the corner; wherein said angle changing means includes:

e) a locking pin bolt having an externally threaded first end that extends through said hinge and an enlarged knurled head with a slot on a second end of said locking pin bolt to make contact with a first side of said hinge and f) an enlarged S-shaped shaft having an internally threaded aperture in a first end for engagement with the externally threaded first end of said locking pin bolt, to make contact with a second side of said hinge, so that said blades can be put at a different angle and retained in that position by the tightening of said knurled head of said locking pin bolt.

2. An adjustable drywall corner tool as recited in claim 1, wherein said handle includes a ferrule which is attached to a second end of said S-shaped shaft.

* * * * *